166-272 SR
7/1/86 OR 4,597,443

United States Patent [19]
Shu et al.

[11] Patent Number: 4,597,443
[45] Date of Patent: Jul. 1, 1986

[54] VISCOUS OIL RECOVERY METHOD

[75] Inventors: Winston R. Shu, Dallas; Kathy J. Hartman, Arlington, both of Tex.

[73] Assignee: Mobile Oil Corporation, New York, N.Y.

[21] Appl. No.: 551,435

[22] Filed: Nov. 14, 1983

Related U.S. Application Data

[63] Continuation-in-part of Ser. No. 320,236, Nov. 12, 1981, abandoned.

[51] Int. Cl.[4] ..... E21B 43/24
[52] U.S. Cl. ..... 166/272; 166/263
[58] Field of Search ..... 166/272, 303, 263, 245, 166/271

[56] References Cited

U.S. PATENT DOCUMENTS

| | | | |
|---|---|---|---|
| 3,353,598 | 11/1967 | Smith | 166/272 X |
| 3,360,045 | 12/1967 | Santourian | 166/272 X |
| 3,483,924 | 12/1969 | Blevins et al. | 166/272 |
| 3,572,436 | 3/1971 | Riehl | 166/272 X |
| 3,572,437 | 3/1971 | Marberry et al. | 166/272 |
| 4,060,129 | 11/1977 | Shu et al. | 166/272 X |
| 4,121,661 | 10/1978 | Redford | 166/272 X |
| 4,450,911 | 5/1984 | Shu et al. | 166/263 |
| 4,491,180 | 1/1985 | Brown et al. | 166/272 |

*Primary Examiner*—Stephen J. Novosad
*Attorney, Agent, or Firm*—Alexander J. McKillop; Michael G. Gilman; Stanislaus Aksman

[57] ABSTRACT

In a thermal method for the recovery of oil from a subterranean, viscous oil-containing formation, a predetermined amount of steam in an amount not greater than 1.0 pore volume and an injection rate of 4 to 7 barrels of steam (cold water equivalent) per day per acre-foot of formation is injected into the formation via an injection well and oil is produced from the formation via a production well. The injection well is then shut-in for a variable time to allow the injected steam to dissipate its heat throughout the formation and reduce oil viscosity while continuing production of oil. Thereafter, a predetermined amount of hot water or low quality steam in an amount not greater than 1.0 pore volume is injected into the formation with continued production but avoiding steam breakthrough. Thereafter, production is continued until there is an unfavorable amount of water or steam in the fluids recovered.

9 Claims, 1 Drawing Figure

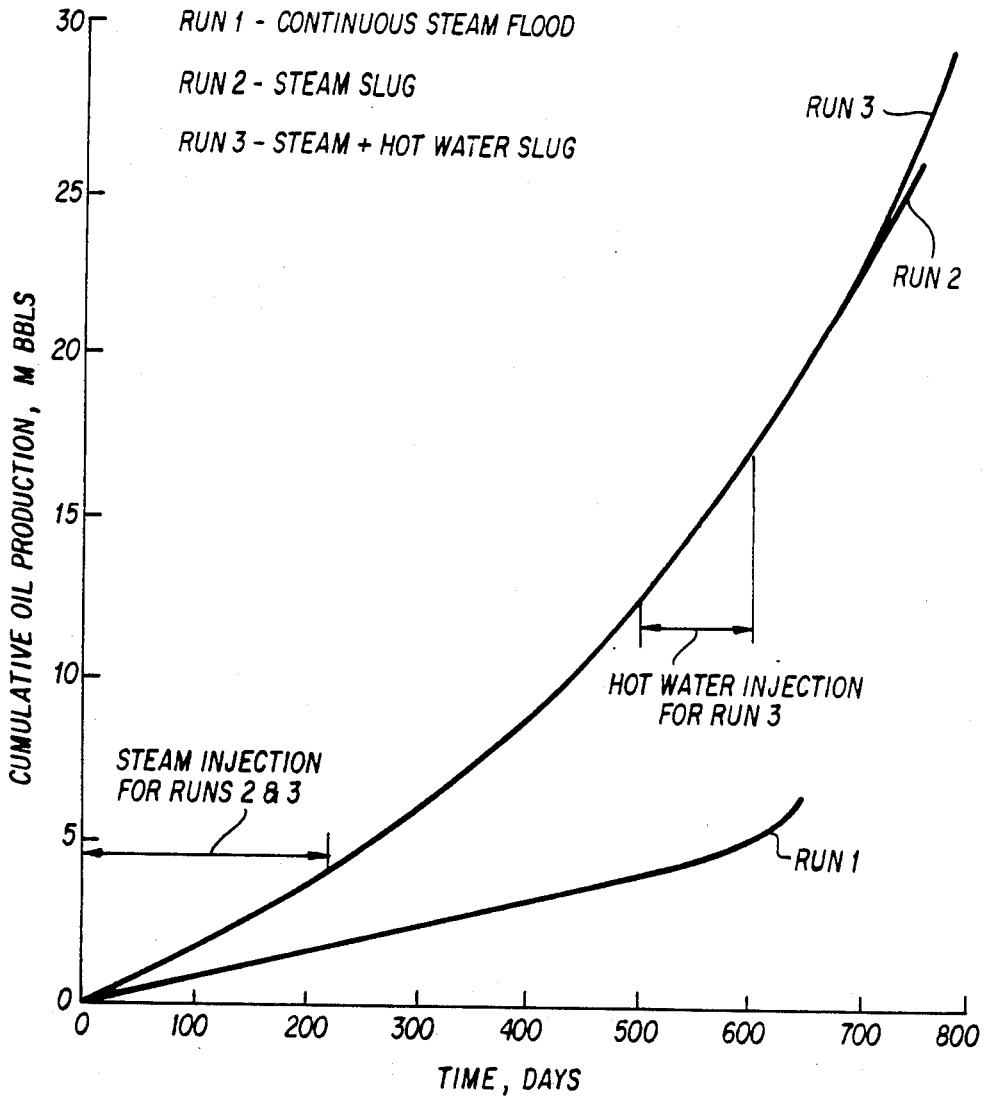
RUN 1 - CONTINUOUS STEAM FLOOD
RUN 2 - STEAM SLUG
RUN 3 - STEAM + HOT WATER SLUG
RUN 3
RUN 2
RUN 1
HOT WATER INJECTION FOR RUN 3
STEAM INJECTION FOR RUNS 2 & 3
CUMULATIVE OIL PRODUCTION, M BBLS
TIME, DAYS
0
5
10
15
20
25
30
0
100
200
300
400
500
600
700
800

VISCOUS OIL RECOVERY METHOD

This application is a continuation-in-part of application Ser. No. 320,236, filed Nov. 12, 1981, now abandoned.

BACKGROUND OF THE INVENTION

1. Field of the Invention

This invention relates to a process for recovering oil from a subterranean, viscous oil-containing formation. More particularly, this invention relates to a thermal method of recovering oil from a viscous oil-containing formation, especially a highly viscous tar sand deposit, employing a sequence of manipulative steps with steam and hot water to obtain maximum heat utilization and oil recovery.

2. Background of the Invention

Increasing worldwide demand for petroleum products, combined with continuously increasing prices for petroleum and products recovered therefrom, has prompted a renewed interest in the sources of hydrocarbons which are less accessible than crude oil of the Middle East and other countries. One of the largest deposits of such sources of hydrocarbons comprises tar sands and oil shale deposits found in Northern Alberta, Canada, and in the Midwest and Western states of the United States. While the estimated deposits of hydrocarbons contained in tar sands are enormous (e.g., the estimated total of the deposits in Alberta, Canada is 250 billion barrels of synthetic crude equivalent), only a small proportion of such deposits can be recovered by currently available mining technologies (e.g., by strip mining). For example, in 1974 it was estimated that not more than about 10% of the then estimated 250 billion barrels of synthetic crude equivalent of deposits in Alberta, Canada was recoverable by the then available mining technologies. (See SYNTHETIC FUELS, March 1947, pages 3-1 through 3-14). The remaining about 90% of the deposits must be recovered by various in-situ techniques such as electrical resistance heating, steam injection and in-situ forward and reverse combustion.

Of the aforementioned in-situ recovery methods, steam flooding has been a widely-applied method for heavy oil recovery. Problems arise, however, when one attempts to apply the process to heavy oil reservoirs with very low transmissibility such as tar sand deposits. In such cases, because of the unfavorable mobility ratio, steam channelling and gravity override often result in early steam breakthrough and leave a large portion of the reservoir unswept. The key to a successful steam flooding lies in striking a good balance between the rate of displacement and the rate of heat transfer which lowers the oil viscosity to a more favorable mobility ratio. Accordingly, this invention provides an improved thermal system for effectively recovering oil from subterranean formations such as tar sand deposits.

SUMMARY OF THE INVENTION

We have discovered that viscous oil may be recovered from a subterranean, viscous oil-containing formation especially a highly viscous tar sand deposit, penetrated by at least one injection well and a spaced apart production well employing injection of a predetermined amount of steam at a predetermined injection rate, shutting-in the injection well for a variable time, and injection of a predetermined amount of hot water or low quality steam with no interruption of production during these steps and avoiding steam breakthrough. Initially a predetermined amount of steam in an amount not greater than 1.0 pore volume and at an injection rate within the range of 4 to 7 barrels of steam (cold water equivalent) per day per acre-foot of formation is injected into the formation via an injection well and fluids including oil are recovered from the formation via a production well. Steam injection temperature is within the range of from 500° F. to 700° F. and steam quality is in the range of 50 to about 90%. Thereafter, the injection well is shut-in and production is continued for a period of time between 1 to 10 days per foot of formation thickness or until the production well pressure declines to a value within the range of one-third to two-thirds of said pressure at the time the injection well is shut-in. Thereafter, a predetermined amount of hot water or low quality steam in an amount not greater than 1.0 pore volume is injected into the formation and production is continued until there is an unfavorable amount of steam or water in the fluids recovered from the formation via the production well.

By practicing the method according to the invention, maximum benefit of the heat content of the steam is obtained with enhanced oil recovery.

BRIEF DESCRIPTION OF THE DRAWING

The attached FIGURE illustrates the production of oil versus time for a run involving injection of steam, a run employing injection of steam for a fixed period of time, and a run employing injection of steam for a fixed period of time subsequently followed by injection of hot water for a fixed period of time.

DESCRIPTION OF THE PREFERRED EMBODIMENT

This invention relates to a thermal recovery method for the recovery of oil from a subterranean, viscous oil-containing formation as a tar sand formation penetrated by at least one injection well and a spaced apart production well. While recovery of the type contemplated by the present invention may be carried out by employing only two wells, it is to be understood that the invention is not limited to any particular number of wells.

A predetermined amount of steam, not greater than 1.0 pore volume, at an injection rate of 4 to 7 barrels of steam (cold water equivalent) per day per acre-foot of formation is injected into the formation via the injection well and fluids including oil are recovered from the formation via the production well. Steam temperature is within the range of 500° to 700° F. and quality in 50% to 90%. The amount of steam injected will vary depending upon the thickness of the formation, the viscosity of the oil, the porosity of the formation, the amount of water in the formation, and the well pattern. The high steam injection rate is essential to the present invention in order to minimize heat loss to surrounding underground strata.

Thereafter, the injection well is shut-in and production of fluids including oil via the production well is continued for a predetermined period of time.

During the time that the injection well is shut-in and production is continued, the injected steam from the initial step condenses in the formation and the resulting heat is allowed to dissipate into the formation reducing the viscosity of the oil. As the heated zone expands, the rate of production increases and the pressure of the formation will gradually decline. An important aspect of the process of the invention during injection well shut-in and production is to avoid steam breakthrough so that maximum benefit of the injected steam is obtained.

Production is continued while the injection well is shut-in with no steam breakthrough until the pressure at the production well has decreased to a value within the range of one-third to two-thirds of said pressure at the time the injection well was shut-in. Alternatively, this step is continued for a predetermined time period of 1 to 10 days per foot of formation thickness.

Thereafter, production of fluids including oil via the produced well is continued and a predetermined amount of a thermal fluid such as hot water or low quality steam is injected into the formation via the injection well. The quality of the steam is not greater than 20%. The amount of hot water or low quality steam injected during this step of the process will be an amount not greater than 1.0 pore volume. The injected thermal fluid pressurizes the formation and increases production of oil. It is preferred during this step to inject hot water as the thermal fluid because, unlike steam, it will not override the formation. In addition, hot water will scavenge heat from the steam previously injected in the formation causing the steam to condense, thereby deterring steam channelling. This results in an extended production time by delaying steam breakthrough. Thus by our process the maximum use of the heat of steam is obtained resulting in increased oil production.

Thereafter, production of fluids including oil is continued until the fluid produced contains an unfavorable amount of water or steam, preferably at least 90%, at which point production is terminated.

Utilizing a computational model and computer program, we will demonstrate the effectiveness of our method. The reservoir data used in the computational model is as follows: Two wells separated by 467 feet are sunk into a reservoir 150 feet thick and containing a heavy crude having a viscosity of 61,900 cp at a reservoir temperature of 55° F. The bottom 20 feet is a water sand with a water saturation of 0.88. After approximately five years of cyclic steam stimulation in both wells, the system is converted to steam flood by making one well an injection well and the other a production well. Three computer simulation runs were conducted and the results are shown by the graphical representation of the attached FIGURE.

Run 1 represents a straight steam flood. Saturated steam at 681 psia and a quality of 78% was injected in one well at a constant rate of 85 barrels per day while the other well was placed on production. Steam breakthrough occurred after 647 days, at which time the cumulative oil production was 6543 stock tank barrels (STB) and the oil/heat input ratio was 0.3257 STB/MM Btu.

In Run 2, steam injection was terminated after 220 days. A total of 65,980 STB (CWE) of steam at a quality of 78% and a pressure of 681 psia was injected into the reservoir over the 220 day period. This corresponds to a steam injection rate of 5 barrels of steam (cold water equivalent) per day per acre-foot of reservoir. Steam breakthrough occurred after 739 days, at which time the cumulative oil production was 26,400 STB and the oil/heat input ratio 1.0950 STB/MM Btu.

In Run 3, steam was injected for 220 days as in Run 2. After a soaking period of 280 days, hot water with 1% steam at 340 psia was injected at a constant rate of 85 barrels per day from 500 to 600 days of the operation. Steam breakthrough occurred after 775 days, at which time the cumulative oil production was 29,390 STB and the oil/heat input ratio 1.1630 STB/MM Btu. Run 3 clearly shows that there is a substantial improvement in oil recovery efficiency over that of a conventional steam flood process (Run 1) and also shows an overall increase in production over Run 2 employing injection of a slug of steam.

By the term "pore volume" as used herein is meant that volume of the portion of the formation underlying the well pattern employed, as described in greater detail in U.S. Pat. No. 3,927,716 to Burdny et al.

What is claimed is:

1. A steam slug method for the recovery of oil from a subterranean, viscous oil-containing formation penetrated by at least one injection well and a spaced apart production well comprising:

(a) injecting a predetermined amount of steam having a quality of 50% to 90% at an injection rate within the range of 4 to 7 barrels of steam (cold water equivalent) per day per acre-foot of formation into the formation via said injection well and recovering fluids including oil from the formation via said production well;

(b) thereafter shutting-in said injection well and continuing to recover fluids including oil from the production well but without steam breakthrough until the pressure at the production well declines to a value within the range of one-third to two-thirds of said pressure at the time said injection well is shut-in;

(c) thereafter injecting a predetermined amount of a thermal recovery fluid comprising hot water or low quality steam into the formation via said injection well; and (d) continuing to recover fluids including oil from the formation via said production well until the recovered fluids contain an unfavorable amount of steam or water.

2. The method of claim 1 wherein the amount of steam injected during step (a) is not greater than 1.0 pore volume.

3. The method of claim 2 wherein production is continued during step (b) but without steam breakthrough for a period of time between 1 to 10 days per foot of formation thickness.

4. The method of claim 3 wherein the amount of hot water injected during step (c) is not greater than 1.0 pore volume.

5. The method of claim 4 wherein the thermal recovery fluid injected during step (c) is low quality steam having a quality not greater than 20%.

6. The method of claim 5 wherein the amount of low quality steam is not greater than 1.0 pore volume.

7. The method of claim 6 wherein production is continued during step (d) until the fluids being recovered contain at least 90% water or steam.

8. The method of claim 1 wherein the steam injection temperature during step (a) is within the range of 500° F. to 700° F.

9. The method of claim 4 wherein the thermal recovery fluid injected in step (c) is hot water.

* * * * *